United States Patent [19]

Noorigian

[11] 4,401,958

[45] Aug. 30, 1983

[54] ELECTROMAGNETIC TRIGGER SWITCH

[76] Inventor: Kenneth C. Noorigian, 1700 Tilton's Corner Rd., Wall Township, Monmouth County, N.J. 07719

[21] Appl. No.: 308,460

[22] Filed: Oct. 5, 1981

[51] Int. Cl.[3] ..... H01H 9/20; H01H 45/00

[52] U.S. Cl. ..... 335/170; 335/165; 335/186; 307/142; 361/194

[58] Field of Search ..... 307/142; 200/157; 74/527; 361/194; 335/186, 170, 165

[56] References Cited

U.S. PATENT DOCUMENTS

| | | | |
|---|---|---|---|
| 3,229,109 | 1/1966 | Wilson | 335/170 |
| 3,893,054 | 7/1975 | Marcoux et al. | 335/186 |
| 3,925,742 | 12/1975 | Muench | 335/170 |
| 4,181,907 | 1/1980 | Esposito et al. | 335/170 |

*Primary Examiner*—Harold Broome

*Attorney, Agent, or Firm*—Lerner, David, Littenberg, Krumholz & Mentlik

[57] ABSTRACT

Apparatus is disclosed for controlling the operation of electrically operated equipment, such as power tools and the like. The apparatus includes circuit connectors, including first and second spaced terminals, in which the first terminal is connected to a source of electricity and the second terminal is connected to the equipment itself so that electricity can be supplied to the equipment by electrically connecting the spaced terminals. The apparatus also includes a switch including a conductor and movable between a first position in which the conductor is not in electrical contact with the spaced terminals and a second position in which the conductor is in electrical contact with the spaced terminals, a locking bar movable between a first position in which the switch is retained in its second position, and a second position in which the locking bar does not interfere with movement of the switch, the locking bar being metallic and therefore being capable of being held in position under the influence of a magnetic field, and an electromagnet for retaining the locking bar in its first position upon activation of the electromagnet.

10 Claims, 11 Drawing Figures

ELECTROMAGNETIC TRIGGER SWITCH

FIELD OF THE INVENTION

The present invention relates to trigger switches, and particularly to trigger switches for use in connection with electrically operated equipment. More particularly, the present invention relates to trigger switches which can be used not only to operate electrically operated equipment, but which can be locked into the "on" position for continuous operation.

BACKGROUND OF THE INVENTION

Numerous electrically operated power tools, both of the hand-held type and much larger pieces of equipment, are now on the market which include various trigger mechanisms intended to control the supply of electric current to the motor driving the tool. Generally, many of these trigger mechanisms are arranged to be proximate to the handle by which the tool is to be held during its operation so that the operator can thus easily control the trigger mechanism at the same time he is grasping the tool handle during operation thereof.

A large number of these trigger mechanisms are known, and a variety of them include mechanisms which permit the selection of various modes of operation for the tool. These generally include a first mode in which the electrically operated equipment will continue operating only so long as the operator continues to manually hold the trigger device in that position, and a second mode or "locked" position in which the tool will continue to operate while at the same time the operator is free to release the trigger mechanism. In such tools, however, subsequent pressing of the trigger is generally required in order to to release the locking mechanism itself.

Examples of such devices are included in U.S. Pat. No. 3,881,081 to Schilling et al., which discloses such a trigger mechanism in which a latch member releasably locks the trigger mechanism in an "on" position. Thus, if the power tool is dropped, for example, the impact causes release of the latch member so as to deactivate the tool. There are also a variety of such devices which include a lock for the trigger switch and in which depression of the trigger switch automatically releases the lock so that it can be returned to its "off" position. These include patents such as U.S. Pat. Nos. 3,383,943 to Piber; 3,329,789 to Sahrbacker; and 4,023,001 to Lafferty.

Finally, as is discussed in a general sense above, a variety of other mechanisms are known in which the locking devices are manually releasable. These devices are quite common and include, as an example thereof, those devices shown in patents such as U.S. Pat. Nos. 3,194,084 to Filander; 3,217,559 to Elligson; and 2,810,051 to Johnson.

Even though a large number of such locking devices for such electrically operated power tools are thus known, injuries from the use of such tools are still quite common. One area where numerous such injuries have occurred in the past is in connection with the interruption of the power supply itself. Thus, with the types of locking systems known in the past, if the tool is being operated in the locked or "on" position, and the power to the tool is interrupted, reinstitution of the power results in immediate operation of the tool which has been left in the locked "on" position. In many cases, the operator forgets that this is the case, and unintended operation of the tool commences, therefore presenting a strong potential for serious injury to the operator.

SUMMARY OF THE INVENTION

In accordance with the present invention, this and other objectives have now been accomplished by providing an apparatus for controlling the operation of electrically operated equipment which includes circuit connection means comprising first and second spaced terminals, the first terminal being adapted for interconnection with a source of electricity and the second terminal being adapted for interconnection with the electrically operated equipment, whereby electricity can be supplied to the equipment by electrically connecting the spaced terminals with each other, interconnection means including conductor means, the interconnection means being movable between a first position in which conductor means is not in electrical contact with the first and second spaced terminals, and a second position in which the conductor means is in electrical contact with the first and second spaced terminals so as to thereby supply electricity to the electrically operated equipment from the source of electricity, locking means movable between a first position in which the locking means retains the interconnection means in its second position, and a second position in which the locking means does not interfere with movement of the interconnection means between its first and second position, the locking means comprising a metal and electromagnet means for retaining the locking means in its first position upon activation of the electromagnet means.

In accordance with a preferred embodiment of the apparatus of the present invention, the electromagnet means is in electrical communication with the second terminal of the circuit connection means so that when the interconnection means is in its second position, electricity is also supplied to the electromagnet means for activating same. In a preferred aspect of this embodiment of the present invention, the second terminal of the circuit connection means includes first and second terminal portions, the first terminal portion being in electrical communication with the electrically operated equipment, and the second terminal portion being in electrical communication with the electromagnet means, so that when the interconnection means is in its second position the conductor means is in electrical contact with the first terminal portion of the second terminal and the conductor means is not in electrical contact with the second terminal portion of the second terminal and the first terminal, and where the interconnection means is movable into a third position in which the conductor means is in electrical contact with both the first and second terminal portions of the second terminal, as well as with the first terminal.

In accordance with a preferred embodiment of the apparatus of the present invention, the conductor means includes a plurality of conductor elements corresponding to the terminal portions.

In accordance with another embodiment of the apparatus of the present invention, the locking means includes a spring member for biasing the locking means into its first position.

In accordance with another embodiment of the apparatus of the present invention, electrically activatable indicator means are provided in electrical contact with the second terminal so that the indicator means is activated upon electrical contact between the first and second terminals. In a preferred aspect of this embodiment of the invention, the indicator means comprises a lamp.

In accordance with another embodiment of the apparatus of the present invention, the circuit connection means comprises first and second wall members so that the interconnection means is movable between those first and second wall members. In one aspect of this embodiment of the apparatus of the present invention, the first wall member includes the first terminal and the second wall member includes the second terminal, the first wall member including a first wall terminal portion, and the second terminal including a plurality of second wall terminal portions, the interconnection means including first and second surfaces facing the first and second wall members respectively, and further including a plurality of conductor means between the first and second surfaces thereof, the conductor means including first and second ends, the first ends of the conductor means being located on the first surface of the interconnection means and the second ends of the conductor means being located on the second surface of the interconnection means, so that when the interconnection means is in its first position the plurality of conductor means are not juxtaposed between the first and second wall members so that electrical contact is not provided between the first and second spaced terminals, and when the interconnection means is in its second position at least one of the plurality of conductor means is in electrical contact with the first wall terminal portion and the second wall terminal portion to thereby supply electricity to the electrically operated equipment from the source of electricity.

In accordance with a preferred embodiment of this aspect of the apparatus of the present invention, the plurality of second wall terminal portions includes primary and secondary second wall portions, the primary second wall terminal portion being adapted for interconnection with the electrically operated equipment and the secondary second wall terminal portion being adapted for interconnection with the electromagnet means, and the interconnection means is movable into a third position so that when the interconnection means is in its second position the conductor means is in electrical contact with the primary second wall terminal portion and the first wall terminal portion to thereby supply electricity to the electrically operated equipment from the source of electricity, and the conductor means is in electrical contact with the secondary second wall terminal portion and the first wall terminal portion to thereby supply electricity to the electromagnet means from the source of electricity, and when the interconnection means is in the third position the conductor means is in electrical contact with the primary second wall terminal portion and the first wall terminal portion to thereby supply electricity to the electrically operated equipment from the source of electricity, but the conductor means is not in electrical contact with the secondary second wall terminal portion and the first wall terminal portion.

BRIEF DESCRIPTION OF THE DRAWINGS

The present invention may be more fully understood with reference to the following figures and detailed description referring thereto. In the figures.

DETAILED DESCRIPTION

Figure 1:
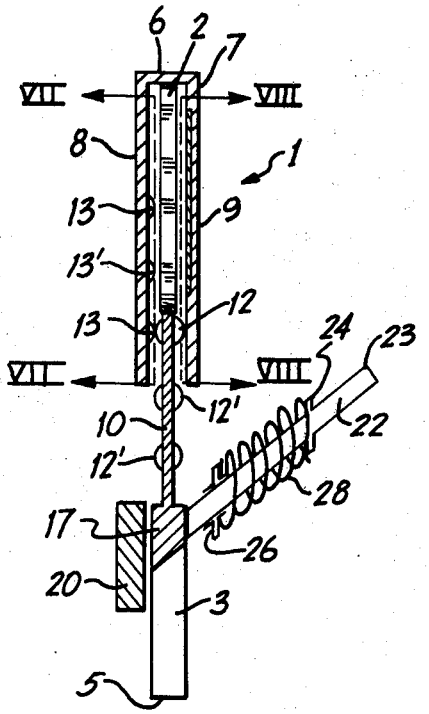
FIG. 1 is a side, partially sectional, elevational view of a switch in accordance with the present invention.
Figure 4:
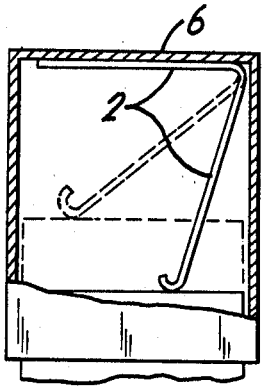
FIG. 4 is a side, partially sectional, elevational view of a portion of the switch shown in FIG. 1.
Figure 2:
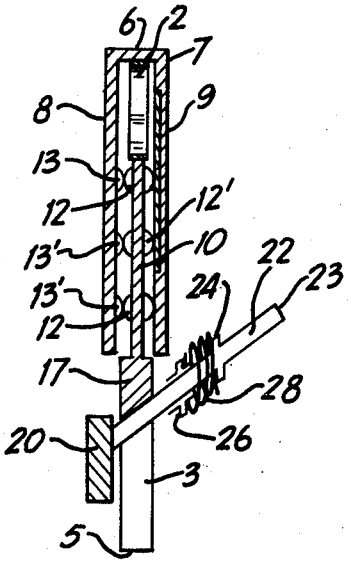
FIG. 2 is a side, partially sectional, elevational view of the switch of FIG. 1 in its locked position.
Figure 3:
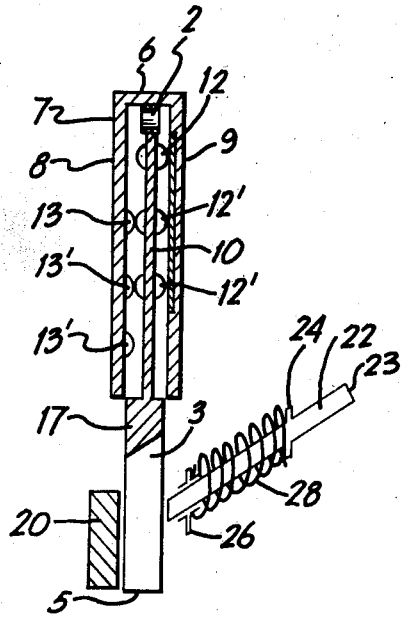
FIG. 3 is a side, partially sectional, elevational view of the switch of FIG. 1 in an alternate position.

Referring to the figures, in which like numerals refer to like portions thereof, FIG. 1 shows an electromagnetic trigger switch 1 hereof. In FIG. 1, the switch is shown in the "off" or non-operational position. The switch 1 includes a trigger member 3, which can be more clearly seen in FIG. 5. The trigger member 3 is thus adapted for movement in the vertical plane as seen in FIGS. 1 through 3, by the manual application of pressure placed on the lower arcuate surface 5 of trigger member 3. However, a leaf spring 2, which can best be seen in FIG. 4, abuts against the end of upper portion 10 of trigger member 3, so as to urge it back into the "off" position shown in FIG. 1. Thus, the leaf spring 2 is shown in FIG. 4 in both its normal, non-operational position, corresponding to the position of the trigger switch as shown in FIG. 1, and in a compressed position, as shown by the dotted lines in FIG. 4, corresponding to the position of the trigger switch as shown in FIG. 2.

A housing 7 is provided in the plane of this vertical motion of the trigger member 3. The housing 7 includes two substantially parallel planar leg portions 8 and 9 on either side of the vertical plane in which trigger member 3 is movable, and a transverse base wall 6 therebetween. In addition, the housing 7 can also include a pair of transverse side walls interconnecting leg portions 8 and 9 in a plane parallel to that of FIG. 1 (now shown therein). Leaf spring 2, which can be any other similar biasing means for returning the trigger member to its "off" position, abuts against the transverse base wall 6, and lies between that wall and the trigger member 3.

The upper portion 10 of trigger member 3 includes pairs of contacts 12 and 12' which extend therethrough, thus protruding from either side of the upper portion 10 of the trigger member 3, as can be seen in FIGS. 1–3.

Figure 7:
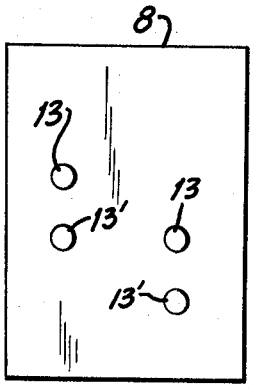
FIG. 7 is a side, elevational view of a portion of the switch of FIG. 1, taken along section VII-VII thereof.
Figure 8:
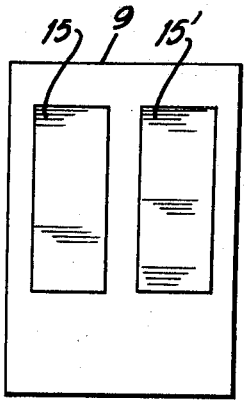
FIG. 8 is a side, elevational view of a portion of the switch of FIG. 1, taken along section VIII-VIII thereof.

One of the legs 8 of the housing 7 includes corresponding pairs of contacts 13 and 13', as can best be seen in FIG. 7. The other leg 9 of the U-shaped housing 7 includes a pair of contact strips 15 and 15', which cover a portion of the face thereof, and which can best be seen in FIG. 8.

Figure 5:
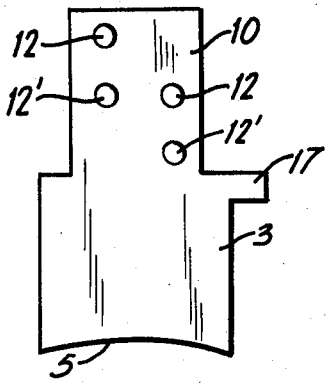
FIG. 5 is a side, elevational view of a portion of the switch of the present invention.

Trigger member 3 also includes an extending shoulder portion 17, which can best be seen in FIG. 5. Adjacent to the trigger member 3 is an electromagnet 20. On the opposite side of trigger member 3 from electromagnet 20 is located a movable lock pin 22. Lock pin 22 is mounted for slidable, longitudinal movement, and includes a protruding collar 24. Collar 24 thus acts in conjunction with a stationary mounted collar portion 26 so that spring member 28, which encircles the lock pin 22, can thus be mounted between the collar portion 24 affixed to lock pin 22 and the stationary mounted collar 26 so as to bias lock pin 22 in the unlocked "on" position as shown in FIG. 1, i.e., towards the right as seen in FIG. 1.

Lock pin 22 is also prevented from movement towards the left as seen in FIG. 1, i.e. towards electromagnet 20, when the trigger member 3 is in the "off" position shown in FIG. 1 by the presence of the shoulder portion 17 between the lock pin 22 and electromagnet 20. Upon actuation of the trigger member 3, i.e., by pressure being exerted on the lower arcuate surface 5 thereof, the trigger member moves upwardly into the position shown in FIG. 2. In this position, both contacts 12 are in electrical contact with both contacts 13 affixed to housing 7. In addition, both contacts 12' are in electrical contact with both contacts 13' affixed to housing 7. Furthermore, the opposite ends of contacts 12 and 12' from those in contact with contacts 13 and 13' are in electrical contact with the contact strips 15 and 15'.

Both contacts 13 are electrically connected to the motor which is utilized to operate the electrically operated equipment. Thus, when the trigger member 3 is in the position shown in FIG. 2, electrical contact both to and from the motor is completed, and the equipment is operational. Furthermore, both contacts 13' on the face 8 of housing 7 are in electrical contact with the electromagnet 20. Thus, the circuit connected to electromagnet 20 is also completed, and the electromagnet is activated.

When the trigger member 3 has been moved out of the "off" position shown in FIG. 1, it is therefore now possible to move the lock pin 22 towards the electromagnet 20 or into the position shown in FIG. 2. This is accomplished by the operator merely pressing on the end of lock pin 22 at the end 23 thereof. Furthermore, since lock pin 22 is metallic, it can then be held by the electromagnetic field created by electromagnet 20 upon its activation, as the trigger member 3 is now in the position shown in FIG. 2. The lock pin 22 is thus held in the position shown in FIG. 2, i.e. directly beneath the shoulder portion 17 of the trigger member 3, and thereby prevents the trigger member 3 from moving back into the "off" position shown in FIG. 1. The trigger switch is thus in the locked position, with the motor driving the equipment being fully operational.

Further pressure on the lower arcuate portion 5 of trigger member 3 now places the trigger member in the position shown in FIG. 3. In this position, both contacts 12' on the trigger member 3 are in contact with both contacts 13 on the face 8 of the housing 7, namely those contacts which are in communication with the motor. However, there are no contacts now in communication with the contacts 13' on that face. Also, the opposite sides of both contacts 12' are also now in contact with contact strips 15 and 15' on face 9 of housing 7, therefore closing the circuit to the motor and operating the equipment thereby. In this condition the circuit to the electromagnet 20 is now open, and the equipment will thus continue to operate only so long as the trigger switch 3 is maintained (i.e., manually) in the position shown in FIG. 3. Since the electromagnet 20 is not activated, the lock pin 22 is no longer held by the electromagnet 20, and is thus urged by the spring member 28, back into its initial position, as shown in FIG. 3, whereby movement of the trigger member 3 in the vertical plane is no longer impeded in any way thereby.

Figure 6:
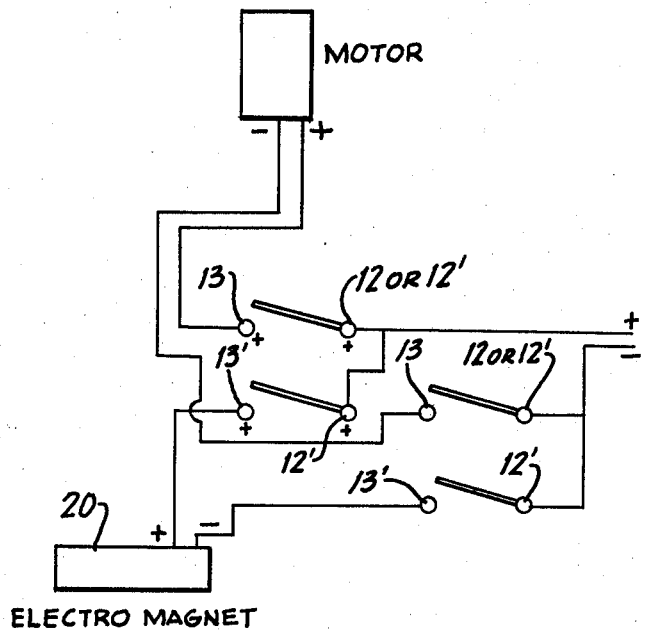
FIG. 6 is a schematic representation of the circuitry used in connection with the present invention.

A schematic representation of the electrical operation of this invention is shown in FIG. 6, in which the open and closed contacts are shown as individual switches therein. As can be seen thereby, the circuits operating the motor can be completed either by the pairs of contacts 12 or the pairs of contacts 12' located on trigger member 3, i.e., when the trigger member is either in the positions shown in FIG. 2 or FIG. 3, respectively. On the other hand, operation of the electromagnet 20 can only be accomplished through the pair of contacts 12', i.e., when the trigger member is in the position shown in FIG. 2. When the trigger member is in the position shown in FIG. 1, however, all of the contacts are in the "open" position as shown in FIG. 6.

It is specifically noted that, even when the trigger member 3 is in the position shown in FIG. 2, that is when the equipment is operating and the locking mechanism is actuated, interruption of the power supply will deactivate electromagnet 20, thereby causing the locking pin 22 to retract into the positions shown in FIGS. 1 and 3. Without separate manual pressure thus being exerted on the arcuate portion 5 of the trigger member 3, the trigger will move into the position shown in FIG. 1, with no contact being supplied in the circuits leading to either the motor or the electromagnet.

Figure 9:
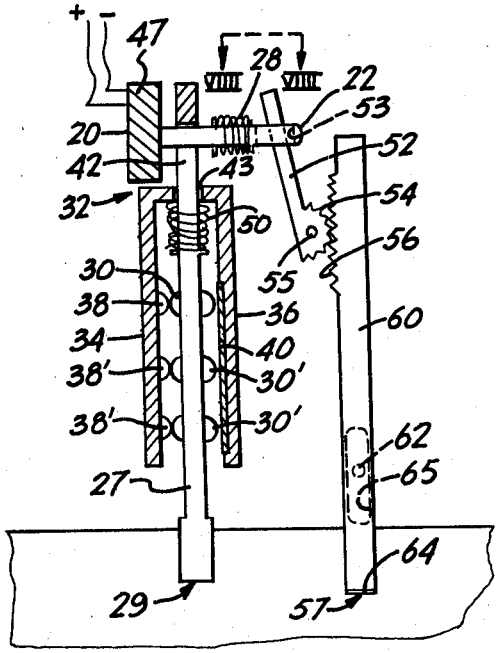
FIG. 9 is a side, partially sectional, elevational view of another embodiment of the switch apparatus of the present invention.

Another embodiment of the invention is shown in FIG. 9, but in this case instead of the trigger member 3 which is shown in FIG. 3, a push-button mechanism is employed. In this case, a contact shaft 27 is provided which can be activated by applying pressure to push button 29 in the direction of the arrow shown in FIG. 9. The side surfaces of the contact shaft 27 will have the appearance of the upper portion 10 of the trigger member 3 shown in FIG. 5. They will thus include pairs of contacts 30 and 30', and the corresponding housing 32, including depending walls 34 and 36, will similarly include pairs of contacts 38 and 38' on leg 34 thereof, as well as contact plates 40 and 40' on leg 36 thereof. In this case, however, the contact shaft 27 includes an upper end 42 which extends through an opening 43 in housing 32. The upper end 42 of contact shaft 27 also includes an L-shaped shoulder 47 which extends outwardly from the contact shaft in a direction out of the plane of FIG. 9. Electromagnet 20 is located on one side of the upper end 42 of the contact shaft 27, and locking pin 22 is maintained on the opposite side thereof.

It can thus be seen that the push-button switch shown in FIG. 9 is in a position corresponding to the position of the trigger member 3 shown in FIG. 3. In this locked position, contact is completed to both the motor operating the electrically operated equipment and to the electromagnet 20. In this manner, locking pin 22 can be moved towards electromagnet 20 to thus contact shoulder 47 on contact shaft 27, and it can be held in that position by the electromagnetic force created by activation of electromagnet 20. This, in turn, prevents movement of the contact shaft 27 from this position to the "open" position corresponding to that of FIG. 1. Once again, however, further pressure on push button 29 will move the switch into a position corresponding to that of FIG. 3, thereby deactivating the electromagnet 20, and permitting continued operation of the motor only by maintaining manual pressure on push button 29. As soon as that pressure is released, however, spring mechanism 50 will urge the contact shaft 27 downwardly as seen in FIG. 6, or back into a position corresponding to that of FIG. 1, in which both the circuits to the motor and to the electromagnet are open.

Figure 10:
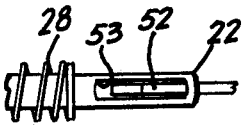
FIG. 10 is a partial, top, elevational view of a portion of the switch shown in FIG. 9.

The mechanism for moving locking pin 22 in this embodiment can also be seen in FIG. 9. The end of locking pin 22 is thus in contact with an arm 52 in the manner shown in FIG. 10. That is, arm 52 passes upwardly through an opening 53 in locking pin 22. The opening 53 is preferably slightly longer than the width of arm 52, so that upon longitudinal movement of locking pin 22, arm 52 can move slightly upward through opening 53, while at the same time moving to the right as shown in FIG. 9. In addition, the opposite end of arm 52 is pivoted at point 55, and includes teeth 54, which are in engagement with ratchet teeth 56 on a movable shaft 60. This mechanism thus controls the movement of locking pin 22 in the following manner. Shaft 60 can be moved in the direction of arrow 57 by the application of manual pressure. This thus operates with a push-button type mechanism similar to that of contact shaft 27. As the shaft 60 moves upwardly as shown in FIG. 9, its ratchet teeth 56, which are in engagement with the teeth 54 on arm 52, thus cause arm 52 to pivot about point 55, with its upper end moving to the left, or away from the plane of shaft 60. Since arm 52 passes through opening 53, this in turn causes locking pin 22 to move to the left, into the position shown in FIG. 9.

Figure 11:
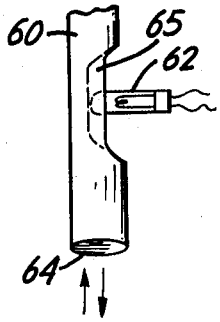
FIG. 11 is a partial, side, elevational view of another portion of the switch shown in FIG. 9.

Furthermore, as an added safety feature, shaft 60 can include an indicator lamp 62, as can best be seen in FIG. 11. An indicator lamp 62, such as a neon lamp, is maintained in a fixed location as shown in FIGS. 9 and 11, and is connected electrically to the same circuit as the electromagnet 20. The end portion of shaft 60 can thus be hollow, or partially hollow, with the indicator lamp located slightly within the shaft 60. This can be done by providing an elongated opening 65 in shaft 60. Furthermore, the end of shaft 60 can include a lens 64, preferably a colored lens, so that the operation of indicator lamp 62 can be easily opened outside of the device. Further, since opening 65 is elongated, shaft 60 can move longitudinally as shown by the arrows in FIG. 11 without interference from the stationary indicator lamp 62.

The indicator lamp operates as an additional safety feature in that if the power supply is in the "on" position and the motor is electrically connected, but for some reason the equipment is not operating, such as due to jamming, etc., the operator can easily tell that the equipment is "hot" by the fact that the indicator light 62 in shaft 60 is illuminated. Thus, as long as power is being supplied to the motor through the switch mechanism, power is also being supplied to the electromagnet and to the indicator lamp, thus indicating this condition visually. The interruption of the power will, of course, also result in the shaft 60 being in the lower or "off" position, but this might not be easily observable by the operator, i.e. it might be at a remote location, etc. Other arrangements, such as color coded bands located on the gear shaft protruding through the equipment, can also be substituted therefor.

It will be understood that the embodiment described herein is merely exemplary and that a person skilled in the art may make many variations and modifications without departing from the spirit and scope of the invention. All such modifications and variations are intended to be included within the scope of the invention as defined in the appended claims.

What is claimed is:

1. Apparatus for controlling the operation of electrically operated equipment comprising circuit connection means comprising first and second spaced terminals, said first terminal adapted for interconnection with a source of electricity and said second terminal adapted for interconnection with said electrically operated equipment, whereby said electricity can be supplied to said electrically operated equipment by electrically connecting said spaced terminals, interconnection means including conductor means, said interconnection means being movable along a first predetermined path between a first position in which said conductor means is not in electrical contact with said first and second spaced terminals, and a second position in which said conductor means is in electrical contact with said first and second spaced terminals to thereby supply electricity to said electrically operated equipment from said source of electricity, locking means movable along a second predetermined path between a first position in which said locking means crosses said first predetermined path, so that when said interconnection means is in said second position, said locking means prevents said interconnection means from moving along said first predetermined path back to said first position, and a second position in which said locking means does not cross said first predetermined path, so that when said interconnection means is in said first position at least a portion of said interconnection means is located in said second predetermined path so as to prevent said locking means from being moved along said second predetermined path from said second position into said first position, said locking means comprising a metal, and electromagnet means located along said second predetermined path for retaining said locking means in said first position upon the activation of said electromagnet means.

2. The apparatus of claim 1 wherein said electromagnet means is in electrical communication with said second terminal of said circuit connection means whereby when said interconnection means is in said second position electricity is also provided to said electromagnet means for activating same.

3. The apparatus of claim 2 wherein said second terminal of said circuit connection means includes first and second terminal portions, said first terminal portion of said second terminal being in electrical communication with said electrically operated equipment, and said second terminal portion of said second terminal being in electrical communication with said electromagnet means, whereby when said interconnection means is in said second position said conductor means is in electrical contact with said first terminal portion of said second terminal and said first terminal and said conductor means is not in electrical contact with said second terminal portion of said second terminal and said first terminal, and wherein said interconnection means is movable along said first predetermined path into a third position in which said conductor means is in electrical contact with both said first and second terminal portions of said second terminal, and with said first terminal.

4. The apparatus of claim 3 wherein said conductor means comprises a plurality of conductor elements corresponding to said terminal portions.

5. The apparatus of claim 1 wherein said locking means includes a spring member for biasing said locking means into said first position.

6. The apparatus of claim 1 including electrically activatable indicator means in electrical contact with said second terminal whereby said indicator means is activated upon electrical contact between said first and second terminals.

7. The apparatus of claim 6 wherein said indicator means comprises lamp means.

8. The apparatus of claim 1 wherein said circuit connection means comprises first and second wall members located substantially parallel to said first predetermined path, whereby said interconnection means is movable between said first and second wall members.

9. The apparatus of claim 8 wherein said first wall member includes said first terminal and said second wall member includes said second terminal, said first wall member including a first wall terminal portion, and said second terminal including a plurality of second wall terminal portions, said interconnection means including first and second surfaces facing said first and second wall members, respectively, and further including a plurality of conductor means between said first and second surfaces thereof, said conductor means including first and second ends, said first ends of said conductor means being located on said first surface of said interconnection means and said second ends of said conductor means being located on said second surface of said interconnection means, whereby when said interconnection means is in said first position said plurality of conductor means are not juxtaposed between said first and second wall members so that electrical contact is not provided between said first and second spaced terminals, and when said interconnection means is in said second position at least one of said plurality of conductor means is in electrical contact with said first wall terminal portion and said second wall terminal portions to thereby supply electricity to said electrically operated equipment from said source of electricity.

10. The apparatus of claim 9 wherein said plurality of second wall terminal portions includes primary and secondary second wall terminal portions, said primary second wall terminal portion being adapted for interconnection with said electrically operated equipment and said secondary second wall terminal portion being adapted for interconnection with said electromagnet means, and said interconnection means is movable along said first predetermined path into a third position, whereby when said interconnection means is in said second position said conductor means is in electrical contact with said primary second wall terminal portion and said first wall terminal portion to thereby supply electricity to said electrically operated equipment from said source of electricity, and said conductor means is in electrical contact with said secondary second wall terminal portion and said first wall terminal portion to thereby supply electricity to said electromagnet means from said source of electricity, and when said interconnection means is in said third position said conductor means is in electrical contact with said primary second wall terminal portion and said first wall terminal portion to thereby supply electricity to said electrically operated equipment from said source of electricity, but said conductor means is not in electrical contact with said secondary second wall terminal portion and said first wall terminal portion.

* * * * *